United States Patent [19]

Norden

[11] 4,056,301

[45] Nov. 1, 1977

[54] RETAINED SCREW ASSEMBLY

[76] Inventor: Alexander R. Norden, 350 Central Park West, New York, N.Y. 10025

[21] Appl. No.: 665,925

[22] Filed: Mar. 11, 1976

[51] Int. Cl.[2] ..... H01R 9/10
[52] U.S. Cl. ..... 339/263 R
[58] Field of Search ..... 339/263, 272, 274

[56] References Cited

U.S. PATENT DOCUMENTS

| | | | |
|---|---|---|---|
| 2,147,160 | 2/1939 | Hagest et al. | 339/272 UC |
| 3,559,156 | 1/1971 | Coley | 339/272 A |

FOREIGN PATENT DOCUMENTS

| | | | |
|---|---|---|---|
| 812,322 | 8/1951 | Germany | 339/272 R |
| 1,211,057 | 11/1970 | United Kingdom | 339/272 R |

*Primary Examiner*—Joseph H. McGlynn

[57] ABSTRACT

A screw for securing a wiring element to a terminal cooperates with a screw retainer including resilient nest means for receiving and releasably retaining the screw head. The screw retainer is movable for carrying the screw away from the terminal so that a wiring element with a hole for the screw can readily be moved into and out of mounting position, and for carrying the screw into position ready to be driven into a threaded hole in the terminal when the wiring element is in position to be tightened in place.

18 Claims, 17 Drawing Figures

FIG.1
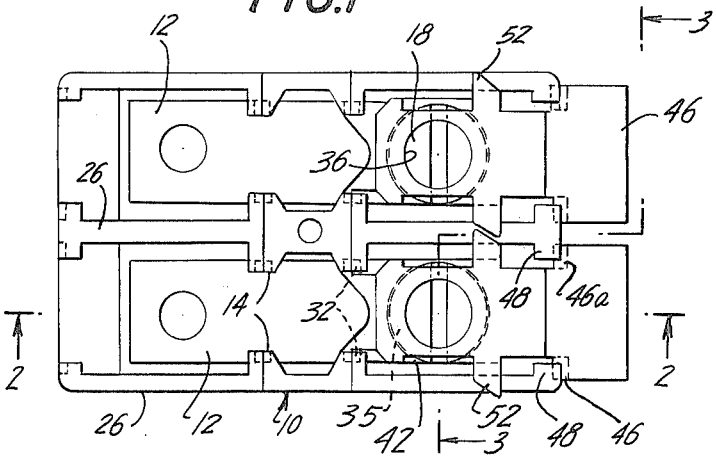
FIG.4
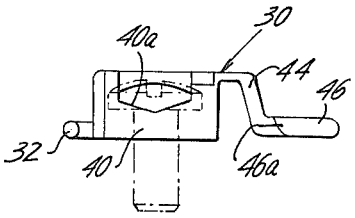
FIG.2
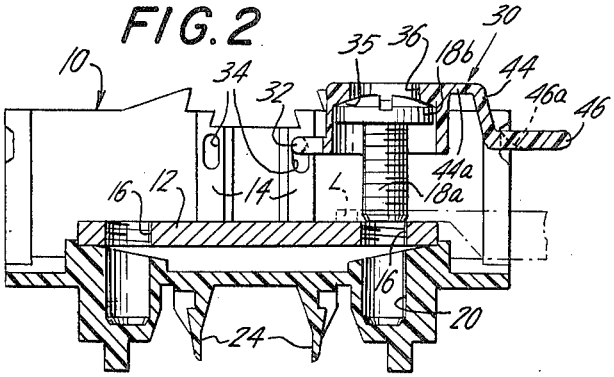
FIG.3
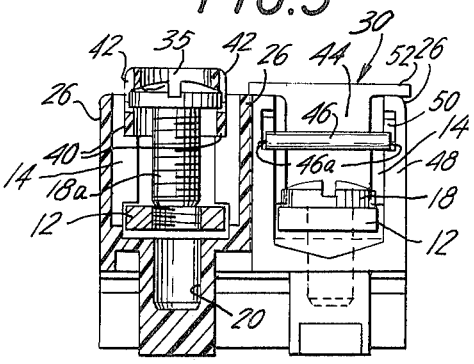
FIG.5
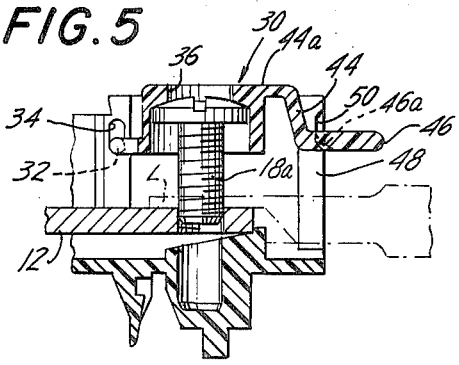
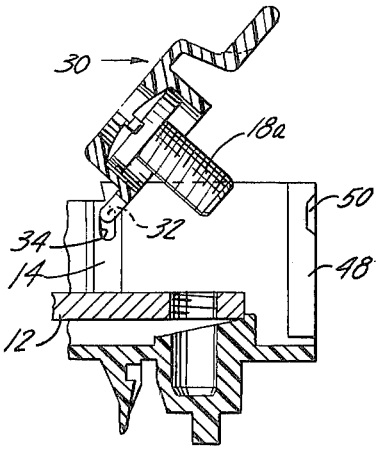
FIG.6
FIG.7
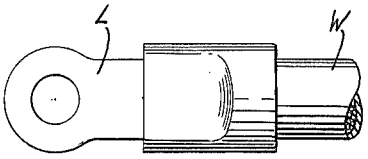
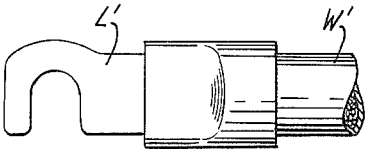
FIG.8

FIG. 9
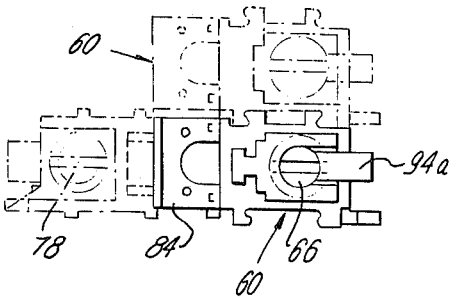
FIG. 11
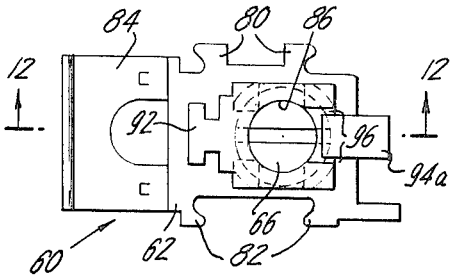
FIG. 10
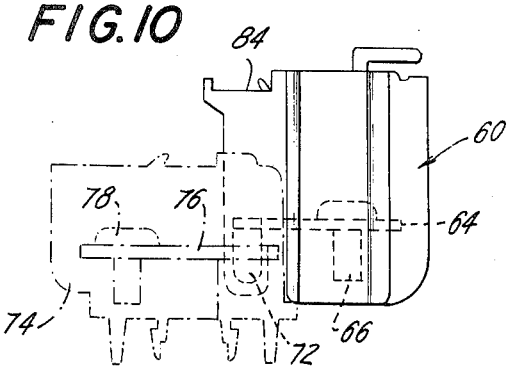
FIG. 12
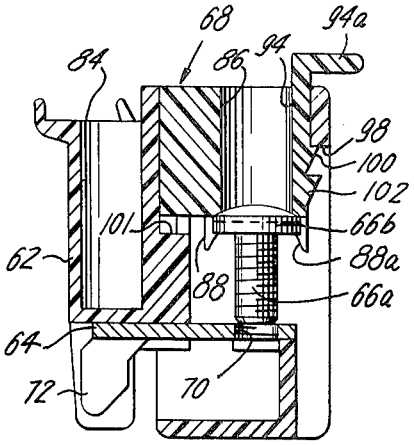
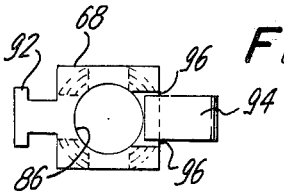
FIG. 14
FIG. 15
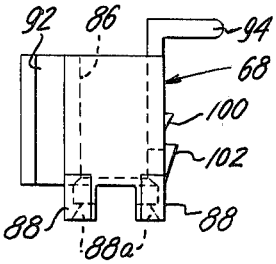
FIG. 17
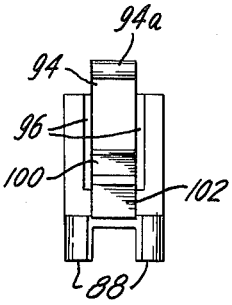
FIG. 13
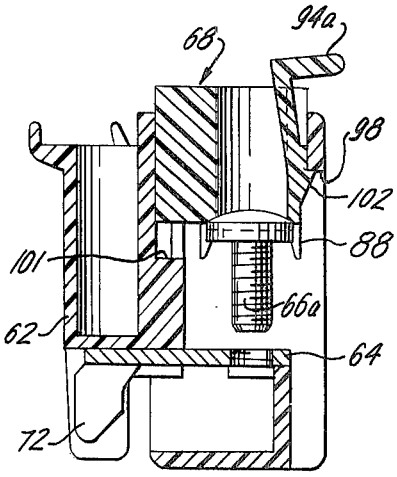
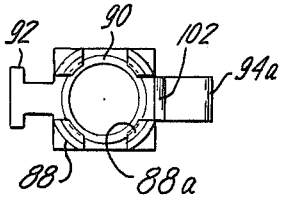
FIG. 16

RETAINED SCREW ASSEMBLY

FIELD OF THE INVENTION

This invention relates to electrical connectors wherein a screw is used to secure a wiring element to a terminal member.

BACKGROUND OF THE INVENTION

The elemental parts of a class of electrical connectors include a metal terminal having a threaded hole, an insulating support for the terminal, and a screw having a head for securing a wiring element to the terminal. Where the wiring element has a straight bare end portion or a forked terminal lug, it is sufficient to loosen the screw, raising the screw head away from the terminal so that a wiring element can be removed from the connector and so that a wiring element can be inserted under the screw head, ready to be tightened to the terminal. A further consideration arises in the case of a wiring element bearing a lug having a hole for the terminal screw, as well as a wiring element having a bare length of wire hooked or completely looped around the screw, and a wiring element having a lug with a slot that opens to one side and is blocked by an insulating barrier against being removed from the screw as long as the screw remains threaded in the terminal. All of these wiring elements are here called "retained " wiring elements. They cannot spring free of the screw in case the screw becomes loosened inadvertently. A wiring element that escapes from the terminal in this way is dangerous, because it could touch another wire or grounded metal structure nearby. What are here called retained wiring elements are often specified to avoid such a risk. They can be removed from the terminal only when the screw is unscrewed entirely.

It is desirable for an electrical connector used with a retained wiring element to have a means for supporting its terminal screw in a position with the threaded end of the screw raised away from the terminal, so that the screw does not interfere with insertion and removal of a retained wiring element. Such a supporting means also retains control of the screw as it is returned to the hole in the terminal. An electrical connector for this purpose is disclosed in my U.S. Pat. No. 3,414,866, issued Dec. 3, 1968.

SUMMARY OF THE INVENTION

An object of this invention resides in providing an electrical terminal with novel screw-supporting means, fulfilling the above purposes and achieving further results and advantages.

The illustrative embodiments of the invention detailed below and shown in the drawings include many features of the invention. As will be apparent to those skilled in the art, certain of these features can be used to advantage without the others.

Each of the novel electrical connectors described in detail below and shown in the accompanying drawings as illustrative embodiments of various aspects of the invention is part of a terminal block having a metal terminal member and a supporting body of insulation. In addition, each of those electrical connectors includes a screw retainer having a nest that resiliently engages the head of the screw. The screw retainer can be lifted to carry a screw away from the terminal. When a lug having a screw hole (or other retained wiring element) is in place, the screw retainer is moved toward the terminal and carries the screw into condition to be tightened.

The nest holds the screw in alignment with the threaded hole of the terminal when a wiring element is to be secured to the terminal. The nest can be an elongated resilient guide laterally gripping the periphery of the screw head. In that case, the screw could be pushed forward by a screw driver, the screw head sliding along the gripping portions of the nest. However, as a distinctive feature in the illustrative embodiments, the nest has formations that not only grip the screw head but also provide a seated location for the screw head directing the axis of the screw toward the threaded hole of the terminal member. The screw retainer is restrained while the screw is being unscrewed from the terminal and while the head of the screw advances forcibly into the seated location in the nest of the screw retainer. Similarly the screw head is forcibly removed from its seated location in the nest while the screw is being driven into the threaded terminal.

As a further feature, the screw head is wholly removed from the nest when the screw is tightened to secure a wiring element. When the screw is being unscrewed, the screw head at first forcibly enters the nest, and then reaches the seated location already described.

As a further feature, the screw retainer is movably connected to the rest of the terminal block so that it can shift through a limited distance between two positions while the head of the screw remains seated in the nest and while the threaded end of the screw is received by a retained wiring element. In one position of the screw retainer, the head of the screw is forcibly advanced into the seated location in the nest as the screw becomes entirely unscrewed from the terminal. The screw retainer is free to move and carry the screw a limited distance from this position closer to the terminal while the screw head remains seated, in the course of establishing initial driving engagement of the threaded end of the screw into the terminal.

The screw retainer and the insulating body have cooperating portions that assure the desired alignment of the screw with the terminal hole. By movably connecting the screw retainer to the stationary part of the terminal block (the part comprising the terminal and the insulating body) a desired orientation of the screw is sustained as it moves away from the terminal and when it subsequently moves toward the terminal. In the first embodiment described below, the screw retainer is pivotally connected to the stationary unit. In that embodiment, in addition to the pivotal motion of the screw retainer for carrying the screw toward and away from the terminal, the pivotal connection allows the screw retainer to shift a short distance toward and away from the terminal as described above for receiving the screw head seated in the nest when the screw is unscrewed and subsequently for establishing initial driving engagement of the screw in the terminal.

Terminal blocks usually have insulating barriers upstanding from the insulating support of the metal terminal member. These are called "interphase barriers" where there are plural metal terminals close to one another. By supporting the screw retainer on the upstanding insulating barriers, the inclusion of the screw retainer does not impair the insulating properties of such barriers. This feature is further assured by making the screw retainer of insulation.

The screw retainer has a nest that receives the screw head from below, and the screw is accessible for operation through a hole in the screw retainer. The space across the top of upstanding insulating barriers is largely covered by the screw retainer which guards the terminal and its screw and the bare portion of the wire element against accidental contact. This feature is enhanced where the screw retainer is of electrical insulation.

The foregoing and other features and advantages of the invention will be better appreciated from the following detailed description of the illustrative embodiments which are shown in the accompanying drawings.

DESCRIPTION OF THE DRAWINGS

FIG. 1 is an enlarged top plan view of a multiple-circuit terminal block forming an illustrative embodiment of various features of the invention, for clarity omitting from the drawing certain parts at the left-hand side of the terminal block.

FIG. 2 is a longitudinal cross-section of the terminal block of FIG. 1 at the plane 2—2 in FIG. 1, with a screw in its position when driven completely out of its companion terminal.

FIG. 3 is an end view partly in cross-section of the terminal block of FIG. 1 as viewed from the line 3—3 in FIG. 1.

FIG. 4 is a lateral view of the screw retainer of FIGS. 1-3.

FIG. 5 is a fragmentary lateral cross-section like FIG. 2, with the screw in initial driving engagement in its companion terminal.

FIG. 6 is a fragmentary cross-section like FIG. 2 with the screw lifted away from its companion terminal by the screw retainer.

FIG. 7 is a retained wiring element drawn to the same scale as FIGS. 1-6 for use with the terminal block of FIGS. 1-6.

FIG. 8 is another form of terminal lug useful with the terminal block of FIGS. 1-6.

FIGS. 9 and 10 are a top plan view and a lateral elevation of a novel plug-in terminal block shown in solid lines, being another embodiment of features of the invention, and companion terminal blocks used with said plug-in terminal blocks and shown in phantom.

FIG. 11 is a top plan view of the novel terminal block of FIGS. 9 and 10, drawn to larger scale than FIGS. 9 and 10, the same scale as FIG. 1.

FIG. 12 is a longitudinal cross-section of the terminal block of FIG. 11 at the plane 12—12 therein.

FIG. 13 is a view like FIG. 12 of the terminal block of FIG. 11, with certain of the parts in changed positions.

FIGS. 14, 15, 16 and 17 are top, front, bottom and side views, respectively, of the screw retainer of the terminal block in FIGS. 11-13.

DESCRIPTION OF THE ILLUSTRATIVE EMBODIMENTS

In FIGS. 1-3, a two-circuit terminal block shown includes a body 10 of molded insulation such as nylon. This material is firm (not rubber-like) and it is resilient. Two rectangular metal members 12 such as copper having high electrical conductivity provide two current paths through the terminal block, providing connections for two circuits. Members 12 are supported and retained in body 10, being guided laterally by four ribs 14, held down in overhanging portions of ribs 14, and restrained against shifting endwise by small steps of the insulating body 10 at the ends of member 12. Each metal member provides two terminal portions or terminals. In the illustrated embodiment, both terminals are screw-type terminals each having a threaded hole 16, and each having a screw 18 for driving engagement in its companion threaded hole. (For clarity, the left-hand screws in FIGS. 1 and 2 are omitted from the drawing, as are the left-hand screw-retainers described below.) The screws shown are bindinghead screws, including a threaded body **18*a* and a head 18*b*. Insulating body 10 has a cavity 20 opposite each screw, deep enough (FIG. 3, at the right) to receive all of body 18*a* that projects through terminal member 12 when the screw head is near or at member 12. Insulating body 10 has formations 22 designed to bear against a supporting surface, and formations 24** that mate resiliently with a retaining rail (not shown) secured to or forming part of the terminal block support.

The terminal block thus far described is conventional. It provides a means for making connections between the wiring elements of two circuits. Insulating body 10 provides ample electrical separation between the two members 12 and from the nearest part of the supporting surface (usually of metal) of body 10. For this purpose, body 10 includes three barriers or walls 26 as upstanding portions of body 10 extending well beyond both ends of members 12 to provide across-the-surface creep distance and through-the-air distance separating the bare metal parts of neighboring circuits. The terminal block thus far described is suitable for virtually any form of wiring element, such as a straight piece of insulated wire having a bared end to be clamped by the head of the binding-head screw 18 against the terminal member 12, or a forked terminal lug having a lengthwise extending pair of legs. If the retaining screw should become loosened accidentally, such a wiring element could spring out of the terminal block and then it could come into contact with other electrical connections or with the metal structure nearby. Serious damage could result. To minimize the potential harm, wiring specifications often require a looped end on each wire, or a wiring elment having insulated wire W bearing a lug L of the form shown in FIG. 7 having a hole, for completely encircling the retaining screw. Loosening of the screw would not allow the wiring element to spring out of place. A laterally open notch in lug L′ (FIG. 8) might also be acceptable, where a lateral barrier of the insulating body 10 prevents the wiring element from escaping even in case of an inadvertently loosened screw.

To insert or remove such a "retained" type of wiring element, it is necessary to fully unscrew and remove the screw. A loose screw could cause trouble if dropped, and in any case it would be desirable to hold and keep control of the screw when it is removed from the terminal member, and until driving engagement in the terminal has been established. The screw retainer 30 performs this and other functions.

Screw retainer 30 is here a member of firm but resilient molded insulation such as nylon. It has oppositely extending pivots 32 received in elongated bearing cavities 34 in a pair of mutually opposite ribs 14. Resilience of the materials of body 10 and member 30 enable the described member 30 to be snapped into the assembled condition shown.

Screw retainer 30 has formations defining a nest, establishing a defined seat for the head of a screw in the retainer and providing screw-retaining means. Peripheral portions of the top of the screw head engage seat portions 35 in retainer 30 around hole 36. This hole provides access to the screw for a screw driver. A wall portion 38 provides a generally cylindrical wall that has a close fit about the screw head, except that lateral resilient wall portions 40 (FIGS. 3 and 4) provide shoulders 40*a* engaging peripheral portions of the underside of the screw head, constraining the head against the seat 35, with the screw centered in the nest and providing consistent aim for the axis of screw body 18*a*. Lateral apertures 42 (FIG. 3) above wall portions 40 facilitate the molding of the shoulders 40*a* and enable wall portions 40 to flex outward when a screw head is forced into the nest. The wide-angled "V" shape of the shoulders 40*a* (FIG. 4) cooperate with the screw head with camming action in biasing the screw head against seat 35, in this way accommodating a latitude of dimensional variations among different screws occurring in screw manufacture.

The portion of screw retainer 30 remote from pivots 32 includes a downward slanting portion 44 and a finger piece 46. Portion 44 is received between ribs 48 on the barriers 26. Finger piece 46 is wider than portion 44 and acts as a latch, each side of finger piece 46 having a detent 46*a* received in a corresponding recess 50 in the respective ribs 48.

Pivots 32 cooperating with their bearings 34 limit displacement of screw retainer 30 toward and away from terminal member 12. Lateral projections 52 cooperate with the upper edges of the barriers to limit descent of the screw retainer toward the terminal member.

The performance of the screw retainer may now be described.

FIG. 6 shows the screw retainer tilted upward about its pivot 32. The free end of screw body 18*a* is lifted well away from terminal member 12, freeing the space above the terminal and between the barriers 26 to receive a "retained" wiring element of either FIG. 7 or FIG. 8. The screw retainer is then moved into the position of FIG. 2, with its axis aligned with the hole and its free end adjacent the threaded hole. The lug L may also be fitted onto the screw body when raised, and then the screw and the lug can be moved in unison as the screw retainer is moved into its position of FIG. 2. The lower surface of detent 46*a* slopes to act as a cam when in engagement with the top of rib 26 during the downward swing of member 30. Bridging portion 44*a* imparts resilience for finger piece 46 enabling detents 46*a* to snap over ribs 26 and into recesses 50.

A screw driver engaged with the screw head 18*b* then drives the free end of the screw into the threaded hole, and as this occurs the screw retainer 30 moves down a short distance. The resulting limited shift of the screw facilitates forming initial threaded engagement of the screw and the threaded hole while orientation of the screw is maintained since the screw head remains seated in the screw retainer. The vertical elongation of bearings 34 that receive smaller pivots 32 as shown, and the vertical enlargement of the recesses 50 that receive smaller detents 46*a* accommodate this downward shift of the screw retainer. The downward shift of screw retainer 30 is limited by pivot 32 reaching the ends of bearings 34, by detents 46*a* reaching the ends of recesses 50 and by projections 52 (FIG. 1) engaging the upper edges of the barriers 26. The described latitude of movement of the screw retainer 30 also accommodates a latitude variation in the length among the screws for this terminal block, resulting from manufacturing tolerances.

Continued forward drive of the screw into the terminal forcibly removes the screw head from the nest, walls 40 flexing outward as this occurs. The screw head leaves the nest, and the head ultimately is tightened against lug L. Walls 40 return to their unstressed condition, avoiding permanent deformation that might occur if the screw head were to remain between walls 40. In this position screw head 18*b* is spaced from the nest. The spacing is less than the length of the screw.

Reverse drive of the screw for removing the wiring element continues until the screw thread is completely disengaged from the thread in the hole. During its upward travel, the screw head forces its way between wall portions 40 of the nest, finally becoming seated in the screw retainer. Upward thrust of the screw against the screw retainer is resisted by engagement of the pivots 32 with the upper limits of their bearings and by engagement of detents 46*a* with the upper limits of recesses 50. Upward thrust of the screw against the screw retainer flexes walls 40 outward and this thrust also tends to flex the retainer upward between its ends. However, this latter flexing also tends to pull detents 46*a* more securely into their recesses 50.

For removing a wiring element after the screw has been unscrewed, finger piece 46 can be grapsed or just lifted. This causes portion 44*a* to flex so as to allow detents 46*a* to snap out of their recesses 50. After the screw has cleared the space over the terminal, the wiring elements can be removed. The screw remains captive and oriented in its seat, ready for re-use as described.

A second embodiment of the broad aspects of the invention, including further aspects identified with this embodiment, is shown in FIGS. 11–13. The terminal block of FIGS. 11–13 has but one screw terminal, in this respect being different from the terminal block of FIGS. 1–6 that has two screw-type terminals for each circuit. Terminal block 60 includes a body 62 of firm but resilient insulation such as nylon, a metal member 64 of high electrical conductivity such as copper, a headed screw 66 having a threaded body 66*a* and a head 66*b*, and a screw retainer 68. Metal member 64 has a threaded hole 70 for screw 66 and a pair of resilient contact portions 72. Terminal block 60 is a plug-in unit that mates with and is carried by a companion stationary plug-in terminal block 74. The latter contains a member 76 as of copper, bearing terminal screw 78 at one end and a contact portion gripped by contact portions 72.

Insulating body 62 has a pair of vertical ribs 80 at one lateral face that provide groove formations complementary to vertical ribs 82 at the opposite lateral face. In this way additional circuits can be added, as by means of another identical plug-in terminal block 60′ (FIG. 9) to mate with its companion stationary terminal block (not shown) alongside of terminal block 74. An area 84 of each terminal block 60 provides space and detents for applying a circuit-identifying label to each terminal block 60.

Screw retainer 68 is of one-piece molded insulation that is resilient but firm, as of nylon. Referring to FIGS. 14–17 in particular, screw retainer 68 is a body having a bore 86 for admitting a screw driver to screw head 66*b*. Four resilient screw-head detents 88 are distributed at regular intervals about seat 90 for the upper peripheral area of the screw head, cooperate with the lateral short cylindrical surface of the screw head and with only outer portions of the underside of the screw head. The body of screw-retainer 68 has four corners that slide in four complementary corners of a cavity in body 62, and screw-retainer 68 has a slide guide 92 of T-shaped cross-section that moves in a complementary guide space in body 62. Finger-piece 94 is flexible and resilient, being divided by lateral slots 96 from the rest of the screw retainer but otherwise finger-piece 94 is an integral portion of the screw retainer.

Body 62 has a shoulder 98 that is engageable by detent 100 on the finger-piece when the screw in nest 88, 90 is unscrewed from terminal 64. At this time, the free end of threaded body **66*a* has just passed out of threaded engagement in hole 70 of the terminal. Portion 94*a* of the finger-piece is spaced away from the upper surface of body 62, and the lower end of slide guide 92 is spaced by a corresponding distance from the lower end 101 of the slide guide. These two clearances make it possible for screw retainer 68 holding a screw head to shift downward as the screw body 66*a* initially establishes driving engagement in threaded hole 70.** As the screw is driven farther in the course of tightening the screw head on an inserted wiring device, the screw head is forcibly withdrawn from the nest.

As a screw is being unscrewed, it engages sloping cam surfaces **88*a* and when detent 100 is arrested by shoulder 98, and unscrewing of the screw is completed, the screw head is forced into its seated location in the nest (FIG. 12**).

For the purpose of lifting the free end of the screw away from the terminal member 64, so that a retained wiring element can be inserted, finger-piece 94 is deflected toward slide-guide 92 (FIG. 13), allowing further upward shift of screw retainer 68. Stop 102 projecting from a firm portion of the screw retainer below finger-piece 94 engages shoulder 98 and arrests the screw retainer against removal from the insulating body.

Generally the screw retainers 30 and 68 cooperate alike with their respective terminal blocks, for like advantages. The sliding construction of the screw retainer in FIGS. 9–17 has the further advantage of being useful where there may not be enough space for the pivoted construction of FIGS. 1–6.

In each embodiment, the screw retainer has a hole for access of a screw driver to the screw head; the screw retainer is a member of insulation permanently held in assembly to the stationary body of insulation, and the screw retainer is movable relative to the stationary body of insulation (a) for arresting the movable screw retainer in one position opposite the threaded hole until the screw has been unscrewed completely, the screw head first forcibly entering the screw retainer and then becoming seated in the nest; (b) for carrying the free end of the screw to a second position spaced away from the threaded hole to facilitate removal and entry of a retained wiring element; (c) for returning the screw into the first position aligned with the threaded hole after a retained wiring element has been inserted into the connector; and (d) for maintaining orientation of the screw as the threaded end of the screw enters into driving relation with the threaded hole, the screw retainer moving to a third position where it is arrested. The screw head is forcibly removed from the screw retainer arrested in its third position as drive of the screw continues, to tighten the wiring element in place.

It would be possible for the user to hold the screw retainer in position by hand as the screw is being unscrewed and enters the nest, but in both embodiments a detent holds the screw retainer in position.

In both embodiments, the screw retainer has resilient members to embrace and grip the screw head and a seat for the head, maintaining the desired orientation of the screw as it moved away from the terminal member and then moved toward the terminal member, and in both cases the screw head is forcibly removed from its seat and entirely leaves the screw retainer when the wiring element is secured to the terminal, and in both cases the screw head forcibly enters the nest and then reaches its seated position when the screw becomes unscrewed completely. It is contemplated that the nest can have elongated resilient portions that grip the head along all of its tightening and unscrewing movements. In that event the elongated resilient portions would be under stress at all times and, because nylon and similar insulating materials are not ideally resilient, the elongated resilient portions could take a set and consequently lose some of their gripping force. Thus it is an advantage for the screw head to move wholly out of the nest in the course of being tightened on a wiring element.

It is contemplated that the nest in each of the two embodiments can have elongated resilient gripping portions but no seat; but then the orientation and aim of the screw would depend only on frictional grip of the screw head, and would not be as secure as where a seat is provided for the head, and where the resilient portions close about the screw head and peripheral portions of the underside of the screw head are engaged by the resilient grippers. As the screw head moves into the seated condition, some of the stress in the resilient portions of the nest is relaxed, reducing the amount of permanent set that might occur and, thus preserving the resilience of the resilient nest portions.

In both embodiments, the underside of the screw head is free of the screw retainer when a screw is tightened against a wiring element or against a washer on a wiring element.

In both embodiments, the body of insulating conventionally provides upstanding insulating barriers above the united assembly of the screw head, the wiring element and the terminal member. The screw retainer serves as a cover over that space that further protects the metal parts against inadvertent contact.

It is possible for a rightened screw to become loosened inadvertently, due to vibration. If that should occur, the screw remains engaged in its threaded hole and retains the wiring element against springing out of the connector where it could create a short-circuit. The screw cannot become inadvertently disconnected from the terminal member because vibration could not cause forcible entry of the screw head into the screw retainer.

The illustrative embodiments shown in the accompanying drawings and described in detail above are subject to a wide latitude of modification, retaining certain features and omitting or replacing others, and the features may be adapted to other applications. Therefore, the invention should be construed broadly in accordance with its full spirit and scope.

What is claimed is:

1. An electrical connector including a stationary unit having a body of electrical insulation and a metal member assembled to said body and having a threaded hole therein, a screw for securing a retained wiring element to said metal member, said screw having a head and a threaded body extending from the underside of the head for driving entry into the threaded hole, and a screw retainer movably connected to said stationary unit and having resilient nest means for releasably retaining said screw head, said stationary unit and said screw retainer having cooperating portions for locating the screw, when the head thereof is in said nest means, in a position ready for insertion into the threaded hole with said threaded body aligned with the threaded hole, said screw retainer being movable relative to said stationary unit for carrying the screw when in the nest means away from said ready-for-insertion position to a removed position with the free end of the screw displaced from the metal member to free the space adjacent the threaded hole for admission and removal of a wiring element.

2. An electrical connector in accordance with claim 1, wherein said nest means includes resilient portions cooperable with peripheral portions of the underside of the screw head when the head is seated in the nest for retaining the screw head in the nest, the resilient portions being adapted to be deflected by the head for releasing the screw from the screw retainer as the screw advances into the threaded hole.

3. An electrical connector in accordance with claim 1 wherein said cooperating portions of the stationary unit and the screw retainer include portions providing pivotal articulation of said screw retainer to said stationary unit.

4. An electrical connector in accordance with claim 1 wherein the nest means has formations defining a seated location of the screw head, and wherein said cooperating portions of the stationary unit and the screw retainer include enlarged-bearing pivot means and detent means including a detent and an enlarged recess therefor for accommodating shift of said screw retainer with a screw head in said seated location between a first position wherein the free end of the threaded body is out of threaded engagement with the threaded hole but adjacent thereto and a second position wherein the end of the threaded body is in driving engagement in the threaded hole, said detent means being disengageable and then said pivot means accommodating pivotal motion of the screw retainer for movement of the screw retainer to said removed position.

5. An electrical connector in accordance with claim 1 wherein said screw retainer is of insulation and is movably connected to said body of insulation.

6. An electricl connector in accordance with claim 1 wherein said nest means has formations definiing a seated location of the screw head therein, and wherein said cooperating portions of the stationary unit and the screw retainer include selective portions for arresting the screw retainer in a first discrete orientation in condition to receive the screw head into said seated location in the nest means as the screw is being unscrewed completely from the threaded hole and for arresting the screw retainer in a second discrete orientation relative to the stationary unit in which the threaded end portion of the screw body is in driving cooperation with the threaded hole while the screw head is in said seated location so that the screw head becomes withdrawn from the nest when the screw is driven further into the threaded hole.

7. An electrical connector in accordance with claim 6 wherein said selective portions coact for arresting said screw retainer against shift from said second discrete orientation toward said threaded hole, and wherein said nest means includes resilient portions cooperable with peripheral portions of the underside of the screw head when the screw head is seated in the nest for releasing the screw head from the screw retainer as the screw is driven into the threaded hole after the screw retainer is arrested against further shift as aforesaid.

8. An electrical connector in accordance with claim 6 wherein said screw retainer is a member of insulation movably connected to said body of insulation for carrying said screw between said ready-for-insertion position and said removed position, said nest means including resilient mutually separated portions retentively and releasably cooperable with peripheral portions of the screw head.

9. An electrical connector in accordance with claim 6 wherein said body of insulation includes upstanding barrier portions disposing a terminal portion of said metal member having said hole therein in a recessed position but exposed for assembling a retained wiring element thereto, said screw retainer being a member of insulation forming a protective cover for said terminal portion but having a hole therein for screw driver access to said screw head.

10. An electrical connector in accordance with claim 1, wherein said body of insulation includes lateral barriers flanking said metal member and wherein said screw retainer is a member of insulation pivotally connected to said body of insulation for operation between said removed position and said ready-for-insertion position, said member of insulation in the latter position constituting a protective cover over the metal member and between said lateral barriers.

11. An electrical connector in accordance with claim 10, wherein said nest means includes resilient portions of said member of insulation embracing peripheral portions of the screw head when in the nest means, and said member of insulation having a hole therethrough for admitting a screw driver to the screw head.

12. An electrical connector in accordance with claim 1, wherein said screw retainer is a member of insulation and said cooperating portions include slide guide portions of said body and said member of insulation constraining said screw retainer to move along the axis of the threaded hole.

13. An electrical connector in accordance with claim 12 wherein said cooperating portions include a resilient detent and a cooperating abutment forming portions of said body and said member of insulation for arresting said screw retainer against movement farther from said metal member than said ready-for-insertion position.

14. An electrical connector, including a stationary unit having a body of electrical insulation and a metal member assembled to said body and having a threaded hole in a terminal portion thereof, a screw having a head and a threaded body extending therefrom for securing a wiring element to said metal member, and a screw retainer movably connected to said stationary unit and having resilient nest means for receiving and releasably retaining said screw head, said stationary unit and said screw retainer having cooperating portions for locating said nest means in a position aligned with and spaced substantially from said head but less than the length of the screw when said head secures a wiring element to said terminal portion, the screw head being driven into said nest means for retention thereby when said screw retainer is located in said position while the screw is being unscrewed from said threaded hole, and said cooperating portions being adapted to accommodate movement of said screw retainer further away from said terminal portion while the head of the screw is in said nest means.

15. An electrical connector in accordance with claim 14, wherein said body of insulation and said screw retainer include cooperating detent means for arresting said screw retainer against movement farther from said terminal portion than the aforesaid position, said detent means being releasable for adapting the screw retainer to carry the screw when the head thereof is in its nest to another position with the body of the screw spaced from said terminal position.

16. An electrical connector in accordance with claim 15, wherein said body of insulation and said screw retainer include mutually engaging portions limiting the movement of the screw retainer away from said terminal portion after the end of the screw has become sufficiently separated therefrom for freely admitting and removing a retained wiring element opposite the terminal portion.

17. An electrical connector, including a stationary unit having a body of electrical insulation and a metal member assembled to said body and having a threaded hole in a terminal portion thereof, a screw having a head and a threaded body extending therefrom and adapted to mate with the threaded hole for securing a wiring element to said metal member between the head of the screw and said terminal portion, and a screw retainer movably assembled to said stationary unit and having resilient nest means for yieldably gripping said screw head when said screw is being unscrewed from said threaded hole, and said screw retainer being movable for increased separation from said terminal portion while the head of the screw is in said nest means for carrying the end of the threaded body away from said threaded hole after being unscrewed therefrom to accommodate insertion and removal of the wiring element.

18. An electrical connector in accordance with claim 17, wherein said nest means is of insulation and constitutes a protective cover over the screw and said metal member, said cover having a hole therethrough aligned with the screw for admitting a screw driver.

* * * * *